US009850119B2

(12) United States Patent
Westrich

(10) Patent No.: US 9,850,119 B2
(45) Date of Patent: Dec. 26, 2017

(54) AUTOMATIC TRUCK TANK FILL SYSTEM

(71) Applicant: Blend-Rite Industries, Inc., South Orange, NJ (US)

(72) Inventor: Milton Westrich, South Orange, NJ (US)

(73) Assignee: Blend-Rite Industries, Inc., South Orange, NJ (US)

( * ) Notice: Subject to any disclaimer, the term of this patent is extended or adjusted under 35 U.S.C. 154(b) by 0 days.

(21) Appl. No.: 15/071,858

(22) Filed: Mar. 16, 2016

(65) Prior Publication Data

US 2017/0267512 A1 Sep. 21, 2017

(51) Int. Cl.

| | |
|---|---|
| ***B65B 31/00*** | (2006.01) |
| ***B67D 7/46*** | (2010.01) |
| ***B67D 7/02*** | (2010.01) |
| ***B67D 7/08*** | (2010.01) |
| ***B67D 7/36*** | (2010.01) |

(52) U.S. Cl.

CPC ..... *B67D 7/46* (2013.01); *B67D 7/02* (2013.01); *B67D 7/08* (2013.01); *B67D 7/362* (2013.01)

(58) Field of Classification Search

CPC ..... B67D 7/0294; B67D 7/04; B67D 7/032; B67D 7/3209; B67D 7/3218; B67D 7/34; B67D 7/344; B67D 7/362; B67D 7/425; B67D 7/44; B67D 7/46

See application file for complete search history.

(56) References Cited

U.S. PATENT DOCUMENTS

| | | | | |
|---|---|---|---|---|
| 3,983,913 | A * | 10/1976 | Bower | B67D 7/0478 141/285 |
| 4,259,975 | A * | 4/1981 | Kinsey, Jr. | G01F 23/02 137/1 |
| 4,763,683 | A | 8/1988 | Carmack | |
| 4,805,672 | A | 2/1989 | Berrettini et al. | |
| 5,056,570 | A * | 10/1991 | Harris | B60K 15/03519 141/302 |
| 5,429,159 | A | 7/1995 | Tees et al. | |
| 5,507,326 | A | 4/1996 | Cadman et al. | |
| 5,515,890 | A | 5/1996 | Koeninger | |
| 5,568,882 | A * | 10/1996 | Takacs | G01F 23/168 222/155 |
| 5,651,400 | A * | 7/1997 | Corts | B67D 7/365 141/198 |
| 5,967,174 | A | 10/1999 | MacDonald | |
| 6,062,276 | A * | 5/2000 | Benjey | B60K 15/03519 137/202 |

(Continued)

*Primary Examiner* — Nicholas J Weiss
*Assistant Examiner* — Randall Gruby
(74) *Attorney, Agent, or Firm* — The Webb Law Firm

(57) ABSTRACT

An automatic truck tank fill system includes a conduit in fluid communication with a fluid supply source. An electrically controlled valve is in fluid communication with the conduit. A fill spout is in fluid communication with the conduit, the fill spout including an outer chamber. A controller is in electrical communication with the valve. A first signal opens the valve from a closed position permitting fluid flow through the conduit, and a second signal causes the valve to close, preventing fluid to flow through the conduit. A tubing is in fluid communication with the fill spout. A pressure transducer is in fluid communication with the tubing, and the controller is in electrical communication with the pressure transducer. When a pressure in the tube reaches or exceeds an activation pressure (P1), the controller sends a signal to close the valve in the conduit.

6 Claims, 5 Drawing Sheets

(56) References Cited

U.S. PATENT DOCUMENTS 6,397,903 B1 6/2002 Coates, III et al.
6,648,174 B2 * 11/2003 Greene ..... B67D 1/00 222/146.6
6,681,815 B1 * 1/2004 Westrich ..... B67D 7/3218 141/198
6,766,837 B1 * 7/2004 Ruffa ..... B67D 7/46 141/198
7,107,971 B2 * 9/2006 Spink ..... B60K 15/03519 123/518
7,543,611 B2 * 6/2009 Kallberg ..... B67D 7/46 141/1
9,297,686 B1 * 3/2016 Ross, Jr. ..... G01F 23/292
9,644,518 B2 * 5/2017 Ham ..... F01N 3/2896
2002/0174910 A1 * 11/2002 Willeke, Jr. ..... B60S 3/045 141/95
2004/0031540 A1 * 2/2004 Peterson ..... B67D 7/362 141/198
2004/0093951 A1 * 5/2004 Viola ..... G01L 23/145 73/728
2005/0263186 A1 * 12/2005 Ricco ..... B60K 15/00 137/392
2005/0279406 A1 * 12/2005 Atwood ..... B60K 15/035 137/39
2008/0295916 A1 * 12/2008 Bonner ..... B67D 7/54 141/206
2009/0218163 A1 * 9/2009 Takeuchi ..... G01R 33/072 180/446
2010/0154534 A1 * 6/2010 Hampton ..... G01F 23/265 73/304 C
2011/0192494 A1 * 8/2011 Poulter ..... B67D 7/145 141/94
2012/0318793 A1 * 12/2012 Uchida ..... B01D 53/22 220/86.2
2016/0060093 A1 * 3/2016 Criel ..... B60K 15/035 137/2
2017/0174501 A1 * 6/2017 Dudar ..... B67D 7/3272

* cited by examiner

AUTOMATIC TRUCK TANK FILL SYSTEM

BACKGROUND OF THE INVENTION

Field of the Invention

The present invention relates to equipment for filling mobile tanks, and in particular, to an automatic truck tank fill system.

Description of Related Art

Many industrial vehicles that use water often have water storage tanks attached to them. Such industrial vehicles include water trucks for street cleaning, fire trucks, and cement concrete trucks. Typically, these trucks are filled manually by an operator, usually the driver of the truck. The operator must remain at the truck while the truck is being filled with water in order to stop the water flow whenever the operator sees that the tank is full. Oftentimes, that individual will become distracted and allow the tank to overflow. The water used to fill these tanks is usually classified as processed water and, thus, any runoff is not cost effective. Also, processed water running off into the ground is usually considered an environmental risk. Reducing the amount of processed water runoff will, in turn, reduce treatment costs associated with clean-up of the runoff water, thereby lowering water contaminant volumes and, thus, the possibility of EPA-generated questions concerning water runoff.

Typically, automatic truck tank fill systems are not used because the truck is movable. Also, filling a truck tank may take a considerable amount of time. If an operator does not monitor the filling of the truck tank, it is very common in the industry that movable trucks will take off with the hose attachments still in place, thereby damaging the water refill system and/or truck. This usually occurs when the operator of the fill system is not the driver of the truck.

Another problem with the automatic fill type system occurs when the tank is full. Generally speaking, if the tank is full and the fill system keeps pumping water, the tank pressure could become dangerously high and cause the tank to fail. Therefore, it is an object of the invention to provide a safety mechanism to the system to prevent such a dangerous situation.

U.S. Pat. No. 6,681,815 is directed to an automatic truck tank fill system that includes an arrangement to automatically shut off the flow of material to a truck tank. The entire contents of U.S. Pat. No. 6,681,815 are incorporated herein by reference.

SUMMARY OF THE INVENTION

In one embodiment, an automatic truck tank fill system includes a conduit adapted to be in fluid communication with a fluid supply source. An electrically controlled valve is in fluid communication with the conduit, the valve having a first open position and a second closed position. A fill spout is in fluid communication with the conduit. The fill spout including an outer chamber. A controller is in electrical communication with the valve. A first signal opens the valve from a closed position, permitting fluid flow through the conduit, and a second signal causes the valve to close, preventing fluid to flow through the conduit. A tubing is in fluid communication with the fill spout. A pressure transducer is in fluid communication with the tubing. The controller is in electrical communication with the pressure transducer. When a pressure in the tube reaches or exceeds an activation pressure (P1), the controller sends a signal to close the valve in the conduit. A tubing breakaway connector may be provided for placing the controller and the fill spout releasably in fluid communication. The conduit may include a pipe having a first end and a second end and a flexible hose having a first hose end and a second hose end, wherein the second end of the pipe is coupled to the first hose end of the hose. The second end of the pipe may be releasably coupled to the first hose end of the hose using a hose breakaway connector. The tubing may be a 0.25 inch diameter ultraviolet resistant poly tubing.

In another embodiment, a method for filling a truck tank using an automatic truck tank fill system includes the steps of: a) placing a truck tank adjacent a filling system; b) providing a fill spout in fluid communication with a conduit, the conduit in fluid communication with a fluid supply source; c) inserting a portion of the fill spout including the outer chamber into an opening in the truck tank; d) filling the truck tank with fluid material flowing from the fluid supply source; and e) stopping the material flow via a controller when an air pressure in the truck tank has reached or exceeded an activation pressure (P1).

In another embodiment, an automatic truck tank fill system includes a pipe in fluid communication with a fluid supply source. A flexible hose is detachably in fluid communication with the pipe. A valve is defined in the pipe. A fill spout is in fluid communication with the hose, the fill spout including an outer chamber. A controller has a start control and a stop control. The controller is in fluid communication with the fill spout by a tubing. The controller is in electrical communication with the valve. The controller causes the valve to open when the start control is activated. The controller causes the valve to close when an air pressure in the truck tank reaches or exceeds an activation pressure (P1) or the stop control is activated.

DETAILED DESCRIPTION OF THE INVENTION

Figure 1:
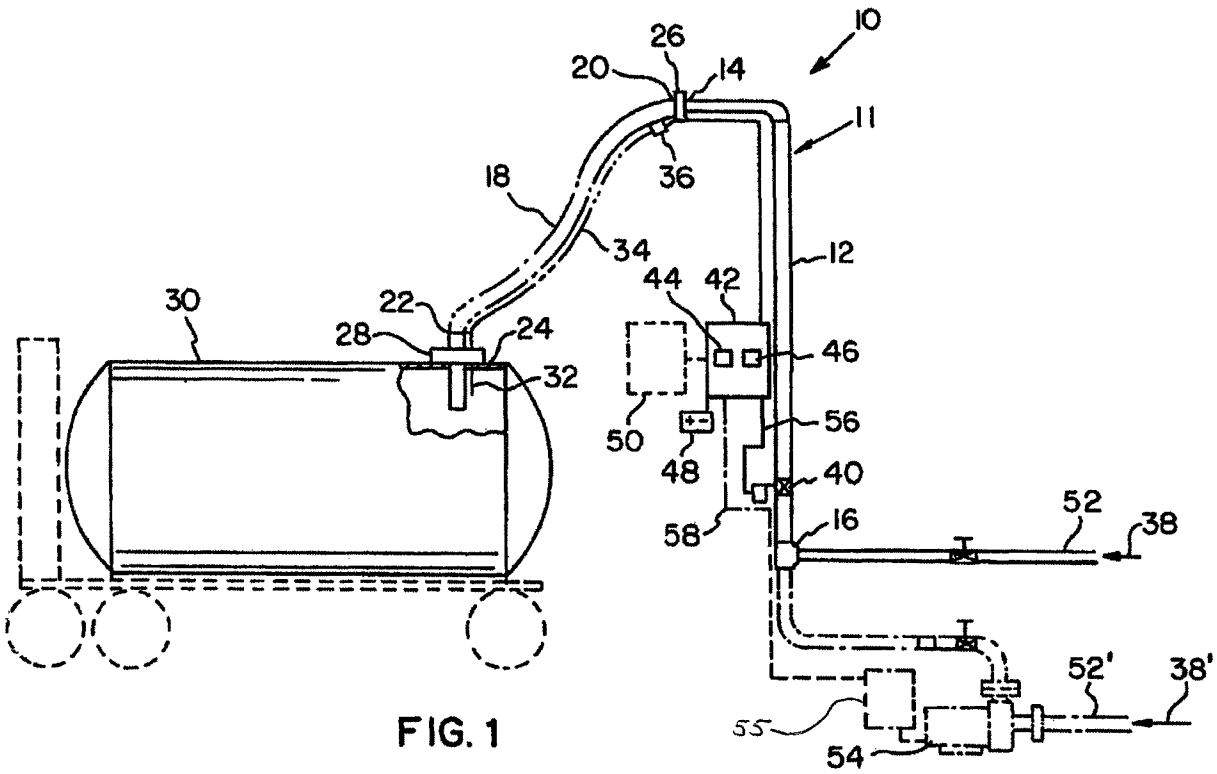
FIG. 1 is a front elevation view of an automatic truck tank fill system having a fill spout and a level sensor inserted into a truck tank.

FIG. 1 shows an automatic truck tank fill system 10 made in accordance with the present invention. The fill system 10 includes a conduit 11 in fluid communication with a fluid supply source 38, 38'. The conduit 11 includes a pipe 12 having a first end 14 and a second end 16 and a flexible hose 18 having a first hose end 20 and second hose end 22. The first end 14 of the pipe 12 is coupled to the first hose end 20 of the hose 18. A hose breakaway connector 26 is used to releasably couple the first end 14 of the pipe 12 to the first hose end 20 of the hose 18. Breakaway connectors are well known in the art and therefore will not be discussed herein. The second hose end 22 is connected to a fill spout 28. The fill spout 28 is adapted to fit inside an opening 24 of a truck tank 30. The fill spout 28 can also be adapted to fit inside other types of tanks, including other types of mobile tanks. The fill spout 28 also has an attached level sensor 32 for determining the presence of a fluid material, such as water whenever the material comes in contact with the sensor 32. Typically, this occurs when the truck tank 30 is full. The level sensor 32 is capable of being in a first state and a second state and can be operated through optics, electrical resistance, and/or electrical capacitance. The sensor 32 is electrically connected to a controller 42 via a sensor wire 34. The sensor wire 34 can include an electronic breakaway connector 36 positioned therebetween for electrically and releasably connecting the sensor 32 to the controller 42. Adjacent the second end 16 of the pipe 12 is a control solenoid valve 40 that opens and closes, thereby starting and stopping the material flow to the truck tank 30. The controller 42 having a start control 44 and a stop control 46 is electrically connected to the valve 40. The controller 42, which is powered by a power supply 48, causes the valve 40 to open and close. A supply line 52 is attached to the second end 16 of the pipe 12 and is used to supply material from a fluid supply source through the conduit 11 to the truck tank 30.

Shown in phantom in FIG. 1 is a pump 54 in fluid communication with the pipe 12. A pump line 52' is attached to the second end 16 at the pipe 12 and is used to supply material from a fluid supply source 38' through the pump 54 and the conduit 11 to the truck tank 30. The pump 54 is also electrically connected to the controller 42. The pump 54 can have a pump controller 55. Also shown phantom in FIG. 1 is an alarm 50 electrically connected to the controller 42. The alarm 50 can be an audible or visible display.

Figure 2:
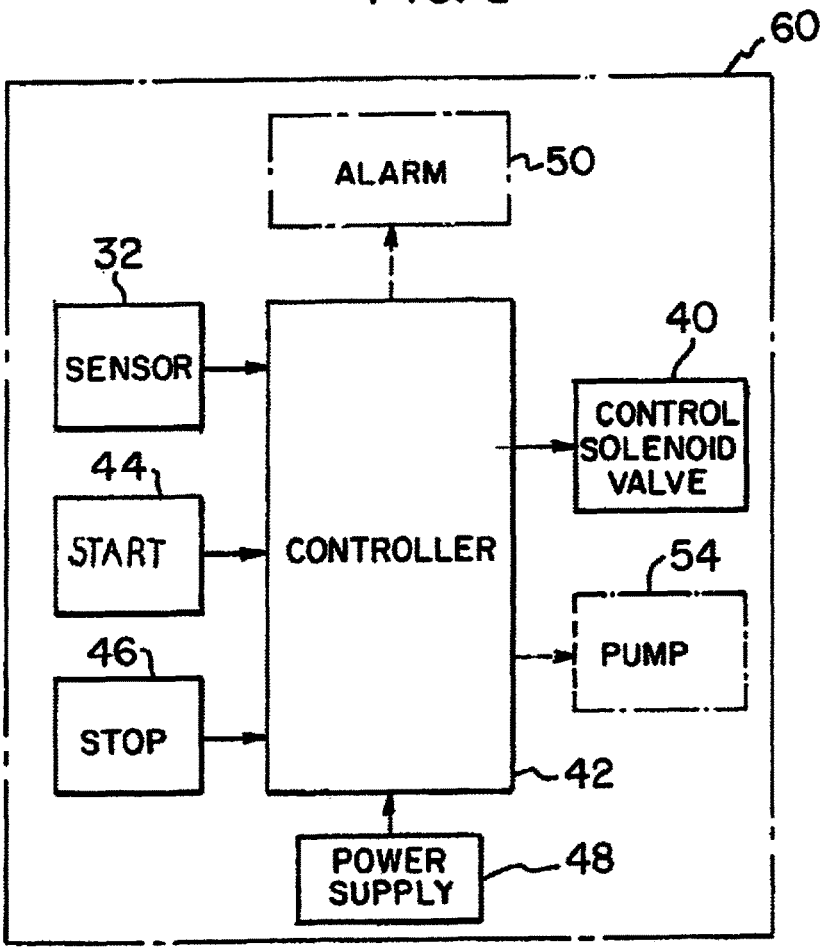
FIG. 2 is a block diagram of a control scheme of the automatic truck tank fill system shown in FIG. 1.

FIG. 2 is a block diagram of a control scheme 60 for the automatic truck tank fill system 10. The power supply 48 is used to supply power to the controller 42. The controller 42 having the start control 44 and the stop control 46 is used to operate the fill system 10. When the start control 44 is activated, a signal is transmitted to the controller 42 causing the valve 40 to open. If the pump 54 (shown in phantom) is used, activating the start control 44 will transmit a signal to the controller 42 causing the pump 54 to start and the valve 40 to open. When the stop control 46 is subsequently activated, a signal is transmitted to the controller 42 causing the valve 40 to close and/or the pump 54 to stop.

The sensor 32 is in the first state when the sensor 32 is not in contact with the fluid material in the truck tank 30. No signal is transmitted to the controller 42 when the sensor 32 is in the first state. When the sensor 32 is activated from the first state to the second state by the material in the truck tank 30 contacting the sensor 32, shown in FIG. 1, a signal is transmitted to the controller 42 causing the valve 40 to close and/or the pump 54 to stop. The controller 42 also has a potentiometer that is capable of compensating for the relative resistance of the fluid, such as water contacting the sensor 32. An adjustable timer can be used to delay the closing of the valve 40 and/or the stopping of the pump 54 after the sensor 32 or the stop control 46 is activated in order to effectively fill the truck tank 30 to the maximum desired level. In addition, the controller 42 causes the alarm 50 (shown in phantom) to activate when the valve 40 closes. Activation of the alarm 50 will produce either an audible sound or visual display, thus alerting the operator that the truck tank 30 is full and/or material flow to the truck tank 30 has stopped.

The control scheme 60 also has a fail safe mode. If there is an electrical power interruption where the power supply 48 ceases to supply power to the controller 42, the controller 42 will cause the valve 40 to close and/or the pump 54 to shut off. The valve 40 is normally in the closed position when there is no electrical power. When power is subsequently restored to the controller 42, the valve 40 remains closed and/or the pump 54 remains shut off. This fail safe arrangement requires the user to activate the start control 44 to continue the filling process.

Figure 3:
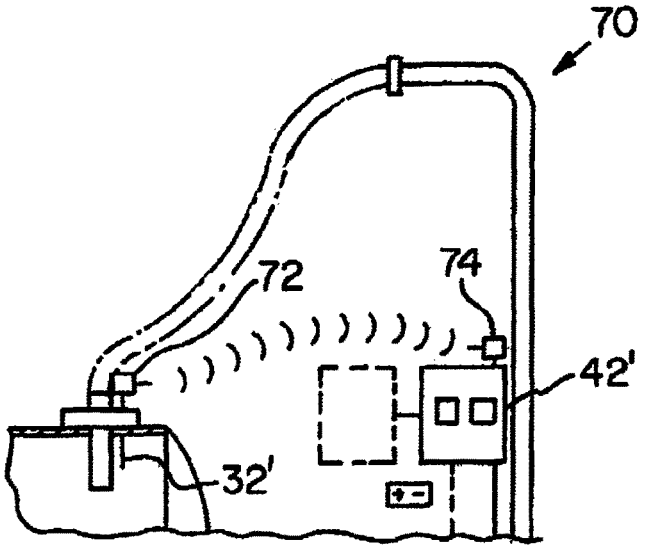
FIG. 3 is a partial front elevation view of a second embodiment of an automatic truck tank fill system that is similar to that shown in FIG. 1, having radio frequency units.

FIG. 3 shows a second embodiment of an automatic truck tank fill system 70 that is similar to the fill system shown in FIG. 1, except that the sensor wire 34 and the electronic breakaway connector 36 are eliminated and replaced with radio frequency units 72, 74. A level sensor 32' is electrically connected to a controller 42' by way of radio frequency waves. A first radio frequency unit 72 is attached to the sensor 32' and a second radio frequency unit 74 is attached to the controller 42'. The first radio frequency unit 72 is used to transmit a signal from the sensor 32' to the second radio frequency unit 74. The second radio frequency unit 74 is used to receive the signal from the first radio frequency unit 72 and transmit the received signal to the controller 42'.

In operation, the driver of the truck tank places the truck tank 30 adjacent to the automatic truck tank fill system 10. The fill spout 28 and the attached level sensor 32 in a first state is inserted into the opening 24 of the truck tank 30 by the operator. The operator then activates the start control 44 thereby opening the valve 40 and/or starting the pump 54. Fluid material from the fluid supply source 38, 38', starts to flow to the truck tank 30. The operator does not need to watch the filling of the truck tank 30. When the material in the truck tank 30 contacts the level sensor 32, thus indicating that the truck tank 30 is full, the sensor 32 will activate to a second state, thereby causing the controller 42 to close the valve 40 and/or shut off the pump 54. The alarm 50 will activate when the valve 40 closes, thus alerting the operator that the truck tank 30 is full. The operator then removes the fill spout 28 from the opening 24 in the truck tank 30. Next, the operator then shuts off the alarm 50 by activating the stop control 46. If the operator is inattentive to the alarm 50, or if the automatic truck tank system 10 does not have the alarm 50, it is possible that the operator could move his truck with the fill spout 28 still inside the opening 24 of the truck tank 30. If this occurs, the hose breakaway connector 26 will cause hose 18 to disconnect from the pipe 12 and the electronic breakaway connector 36 will cause the sensor wire 34 to disconnect from the controller 42, thereby reducing the damage to the fill system 10.

Figure 4:
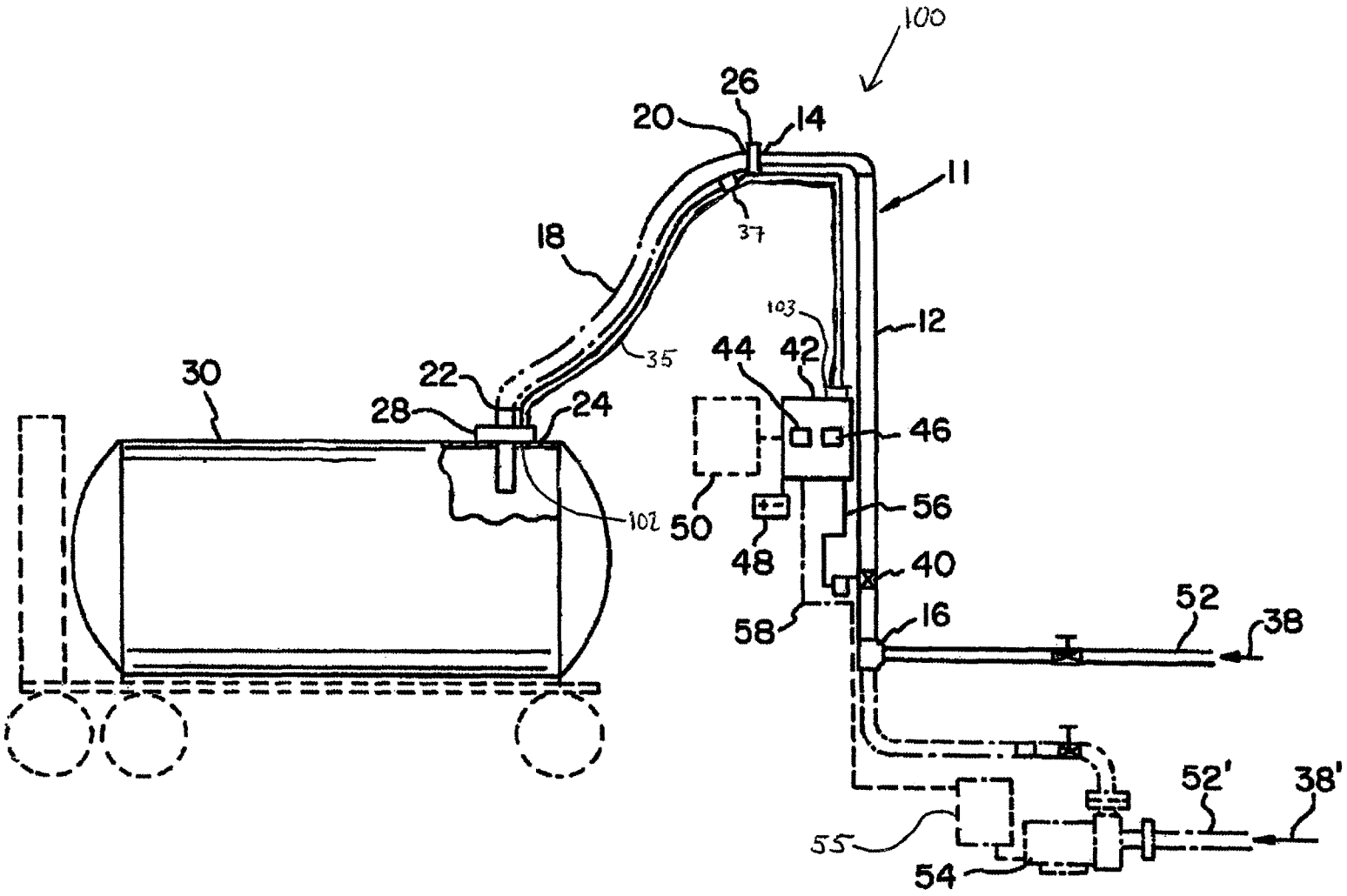
FIG. 4 is a front elevation view of an automatic truck tank fill system made in accordance with the present invention having a fill spout with an outer chamber.

FIG. 4 shows an embodiment of an automatic truck tank fill system 100 according to the present invention. The fill system 100 is the same as the fill system 10 from FIG. 1, except for the below noted differences. Specifically, this embodiment eliminates the level sensor 32 and replaces it with a pressure sensing arrangement discussed below.

A fill spout 28 is adapted to fit inside an opening 24 of a truck tank 30 or other type of tank or mobile tank. The fill spout 28 includes an outer chamber 102. The fill spout 28, and, in particular, the outer chamber 102 of the fill spout 28, is in fluid communication with the controller 42 via a tubing 35. In one embodiment, the tubing 35 is a 0.25 inch diameter ultraviolet resistant poly tubing, but the tubing can be made of any other suitable material. The tubing 35 can include a tubing breakaway connector 37 positioned therebetween for making the fill spout 28 and the controller 42 releasably in fluid communication with each other to prevent damage to the fill system 100. A pressure transducer 103 is also in fluid communication with the tubing 35. The pressure transducer 103 is in electrical communication with the controller 42. The pressure transducer 103 is configured to read the pressure of the air in the tubing 35 and relay that pressure reading to the controller 42.

With continued reference to FIG. 4, the fill spout 28, including the outer chamber 102, is inserted into the opening 24 and remains in the truck tank 30 while the system is filling. The fill spout 28 delivers fluid material, such as water, to the truck tank 30. As water fills the truck tank 30, air pressure in the truck tank 30 increases due to the air being compressed in the truck tank 30 as the truck tank 30 fills with water or other liquid. When the air pressure in the tubing 35, which is the same as the air pressure in the truck tank 30, reaches an activation pressure (P1), the controller 42 causes the fluid supply delivered to the truck tank 30 to shut down (i.e., closes the valve 40).

The controller 42 includes a start control 44, which starts the #ill cycle, and a stop control 46 which stops the fill cycle at any time. The stop control 46 also serves as an emergency shut off. The controller 42, having the start control 44 and the stop control 46, is in electrical communication with the valve 40, such as a solenoid valve, adjacent to the second end 16 of the pipe 12. The valve 40 has a first open position and a second closed position. The controller 42, which is powered by a power supply 48, sends a first signal that opens the valve 40 from a closed position, permitting fluid flow through the conduit 11. A second signal causes the valve 40 to close, preventing fluid flow to the conduit 11.

As the fluid level in the truck tank 30 rises, air from the truck tank 30 flows through the tubing 35, and the air pressure in the tubing 35 has an air pressure substantially identical to the air pressure in the truck tank 30. The pressure transducer 103 reads the air pressure of the air in the tubing 35 and relays that pressure reading to the controller 42. The controller 42 is set to shut off the fluid supply after a pressure reading at or exceeding the activation pressure (P1). The activation pressure (P1) can be changed by a user so that the truck tank 30 is filled to a desired level. In one embodiment, the predetermined pressure is set to a level that allows the truck tank 30 to be filled to a maximum level without spillage. The predetermined pressure may also be set so that the fluid level fills the truck tank 30 to a lower level.

The truck tank 30 is filled according to the present invention by inserting the fill spout 28, including the outer chamber 102, into the truck tank 30. The start control 44 is activated to open the valve 40, such as electrically energizing a solenoid valve, which starts the delivery of the fluid supply to the fill spout 28, and, ultimately, the truck tank 30. While filling, the air from the truck tank 30 flows through the tubing 35 to the pressure transducer 103. The pressure transducer 103 reads the pressure of the air in the tubing 35 and sends that reading to the controller 42. When the air pressure has reached or exceeded an activation pressure (P1), the controller 42 automatically closes the valve 40, such as by de-energizing a solenoid valve. This stops the fluid supply flow to the truck tank 30. At any time during filling, the stop control 46 can be activated to stop the fluid supply to the truck tank 30.

Figure 5:
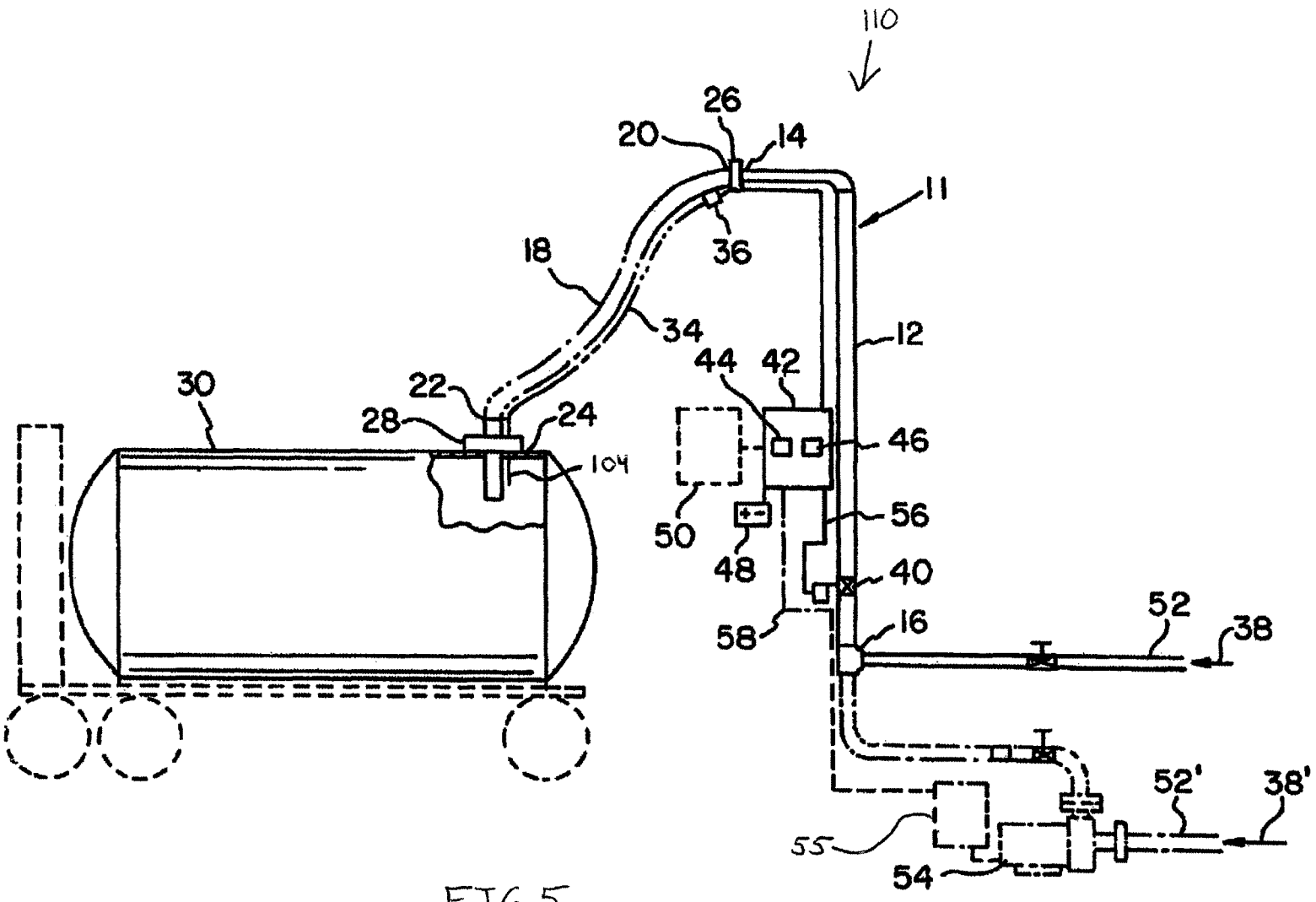
FIG. 5 is a front elevation view of an automatic truck tank fill system made in accordance with the present invention having a pressure sensor in electrical communication with a controller.

FIG. 5 shows an embodiment of an automatic truck tank fill system 110 according to the present invention. The fill system 110 is the same as the fill system 10 from FIG. 1, except for the below noted differences. In the embodiment in FIG. 5, the level sensor 32 is eliminated and replaced with a pressure sensor 104. The pressure sensor 104 is configured to read the air pressure in the truck tank 30. The pressure sensor 104 is in electrical communication with the controller 42 via the sensor wire 34. While the truck tank 30 is filling, the pressure sensor 104 reads the air pressure in the truck tank 30 and sends this pressure reading to the controller 42 through the sensor wire 34. When the air pressure in the truck tank 30 reaches or exceeds the activation pressure (P1), the controller 42 sends a signal to close the valve 40.

Figure 6:
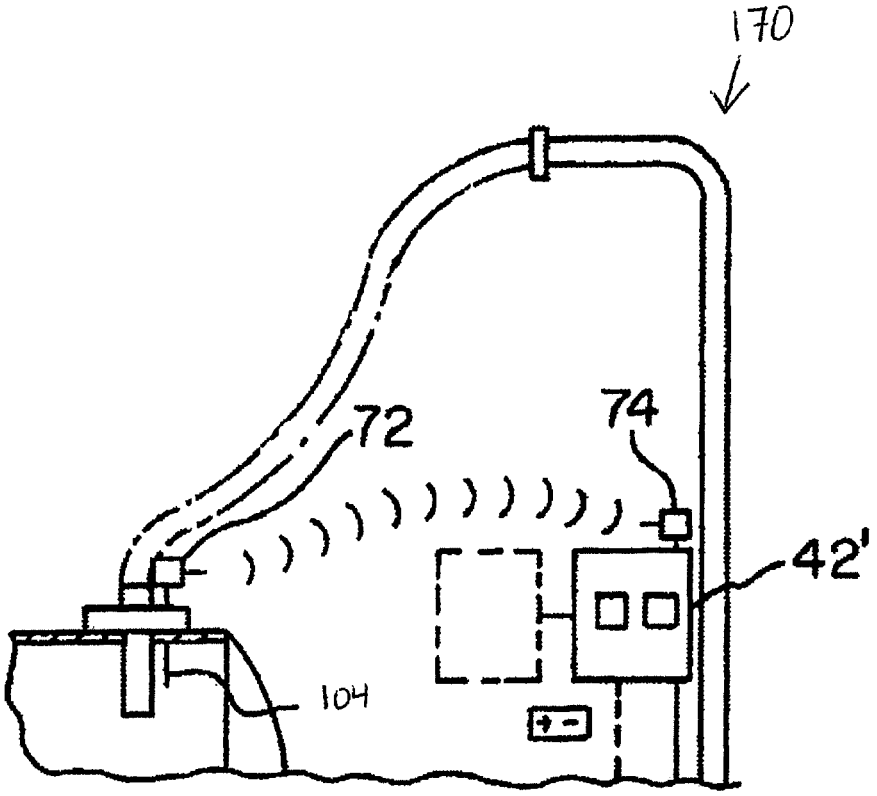
FIG. 6 is a partial front elevation view of an automatic truck tank fill system made in accordance with the present invention, similar to that shown in FIG. 5, having radio frequency units.

FIG. 6 shows an embodiment of an automatic truck tank fill system 170 according to the present invention. The fill system 170 is the same as the fill system 70 from FIG. 3 except for the below noted differences. In the embodiment in FIG. 6, the level sensor 32' is eliminated and replaced by a pressure sensor 104 in electrical communication with the controller 42 by way of radio frequency waves. The pressure sensor 104 is in electrical communication with the first radio frequency unit 72. The controller 42 is in electrical communication with the second radio frequency unit 74. While the truck tank 30 is filling, the pressure sensor 104 reads the air pressure in the truck tank 30 and sends that reading to the first radio frequency unit 72. The first radio frequency unit 72 then sends the air pressure reading to the second radio frequency unit 74 via radio waves, which sends the air pressure reading to the controller 42. When the air pressure in the truck tank 30 reaches or exceeds the activation pressure (P1), the controller 42 sends a signal to close the valve 40.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limited as to the scope of the invention which is to be given the full breath of the appended claims and any and all equivalence thereof.

What is claimed is:

1. An automatic truck tank fill system comprising:

a conduit adapted to be in fluid communication with a liquid supply source;

an electrically controlled valve in fluid communication with the conduit, the valve having a first open position and a second closed position;

a fill spout in fluid communication with the conduit, the fill spout comprising an outer chamber;

a controller in electrical communication with the valve, wherein a first signal opens the valve from a closed position, permitting fluid flow through the conduit, and wherein a second signal causes the valve to close, preventing fluid to flow through the conduit;

a tubing in fluid communication with the fill spout;

a pressure transducer in fluid communication with the tubing, the controller in electrical communication with the pressure transducer, wherein when a pressure in the tube reaches or exceeds an activation pressure (P1), the controller sends a signal to close the valve in the conduit;

a tubing breakaway connector placing the controller and the fill spout in releasable fluid communication; and the controller positioned intermediate the tubing breakaway connector and the valve, wherein in operation of filling a truck tank, the tank includes air, the air in communication with the tubing and pressure transducer, the fill spout is in fluid communication with the tank and liquid fills the tank, air pressure increasing in the tank until the pressure reaches the activation pressure (P1) and the controller sends a signal to close the valve and stop the flow to the fluid supply.

2. The fill system of claim 1, wherein the conduit comprises a pipe having a first end and a second end and a flexible hose having a first hose end and a second hose end, wherein the second end of the pipe is coupled to the first hose end of the hose.

3. The fill system of claim 2, wherein the second end of the pipe is releasably coupled to the first hose end of the hose using a hose breakaway connector.

4. The fill system of claim 1, wherein the tubing is a 0.25 inch diameter ultraviolet resistant poly tubing.

5. A method for filling a truck tank using an automatic truck tank fill system as set forth in claim 1, the method comprising the steps of:

placing a truck tank adjacent a filling system;

providing a fill spout in fluid communication with a conduit, the conduit in fluid communication with a fluid supply source;

inserting a portion of the fill spout, including the outer chamber, into an opening in the truck tank;

filling the truck tank with fluid material flowing from the fluid supply source; and stopping the material flow via the controller when an air pressure in the truck tank has reached or exceeded an activation pressure (P1).

6. An automatic truck tank fill system comprising;

a pipe in fluid communication with a liquid supply source;

a flexible hose detachably in fluid communication with the pipe;

a valve defined in the pipe;

a fill spout in fluid communication with the hose, the fill spout comprising an outer chamber;

an air pressure sensor in communication with the controller and the tank;

a controller having a start control and stop control, the controller in fluid communication with the fill spout by a tubing and the controller in electrical communication with the valve, wherein the controller causes the valve to open when the start control is activated, and wherein the controller causes the valve to close when an air pressure in the truck tank reaches or exceeds an activation pressure (P1) or the stop control is activated; and the controller is positioned intermediate the valve and the flexible hose, wherein during the filling operation of the tank as liquid is flowing into the tank, air is in the tank and as the tank fills the air pressure will increase until it reaches the activation pressure (P1).

* * * * *